US007690537B2

(12) United States Patent
Yates et al.

(10) Patent No.: US 7,690,537 B2
(45) Date of Patent: Apr. 6, 2010

(54) PORTABLE LIQUID DISPENSER

(75) Inventors: James M. Yates, Akron, OH (US); Andrew R. Spriegel, Massillon, OH (US); Robert L. Quinlan, Stow, OH (US)

(73) Assignee: GOJO Industries, Inc., Akron, OH (US)

( * ) Notice: Subject to any disclaimer, the term of this patent is extended or adjusted under 35 U.S.C. 154(b) by 1163 days.

(21) Appl. No.: 11/259,486

(22) Filed: Oct. 27, 2005

(65) Prior Publication Data

US 2007/0095861 A1 May 3, 2007

(51) Int. Cl.
*B65D 88/54* (2006.01)

(52) U.S. Cl. ..... 222/323; 222/321.7; 222/321.9; 222/465.1; 222/481.5; 222/482

(58) Field of Classification Search ..... 222/465.1, 222/192, 321.7, 323, 321.9, 385, 481.5, 372, 222/383.1, 482, 182–183
See application file for complete search history.

(56) References Cited

U.S. PATENT DOCUMENTS 2,723,056 A * 11/1955 Smith ..... 222/396
3,993,251 A 11/1976 des Garets
4,030,664 A * 6/1977 Tisbo et al. ..... 239/289
4,890,767 A * 1/1990 Burlison ..... 222/78
4,903,864 A * 2/1990 Sirhan ..... 222/78
4,923,098 A * 5/1990 Schoonover et al. ..... 222/465.1
5,056,691 A * 10/1991 Tolbert ..... 222/466
6,068,163 A * 5/2000 Kihm ..... 222/189.1
6,293,692 B1 * 9/2001 Bowsher et al. ..... 366/130
6,799,700 B2 * 10/2004 Durant et al. ..... 222/129
7,216,780 B2 * 5/2007 Durant et al. ..... 222/129
2006/0032867 A1 * 2/2006 Grant ..... 222/192

FOREIGN PATENT DOCUMENTS

FR 2 545 382 A1 5/1983
WO WO 2006/018726 A1 2/2006

* cited by examiner

*Primary Examiner*—Frederick C. Nicolas
(74) *Attorney, Agent, or Firm*—Renner, Kenner, Greive, Bobak, Taylor & Weber

(57) ABSTRACT

A portable liquid dispenser includes a blow molded housing defining a cavity within the entire interior thereof. A centralized walled aperture is provided to receive an appropriate dispensing pump, the pump being configured to extend outwardly in a usable position and to lock in an inwardly position where the dispensing nozzle of the pump does not extend beyond the sidewalls of the dispenser itself. A fill and relief valve is provided to accommodate rapid filling of the dispenser during a manufacturing process, and to accommodate breathing of the container during the dispensing operation such that the unvented pump does not result in any distortion of the dispenser as the liquid therein is depleted.

18 Claims, 4 Drawing Sheets

PORTABLE LIQUID DISPENSER

TECHNICAL FIELD

The invention herein resides in the art of liquid dispensers and, more particularly, to portable dispensers adapted to be received upon horizontal planar surfaces, or hung on vertical surfaces. More particularly, the invention relates to a disposable portable dispenser having a blow molded integral housing, and characterized by a fill and relief valve that allows for positioning of the pump of the dispenser below the level of fluid contained therein.

BACKGROUND ART

The awareness of the need for proper hand hygiene has increased the need for the availability of dispensers having hand cleaning solution contained therein. Typically, apart from residential use, the dispensers for such solutions are typically at fixed locations, mounted on a wall or counter. Such dispensers are typically characterized by an exterior housing having a lever or other actuating mechanism that engages a pump that comprises a portion of a disposable refill or cartridge. However, the need for proper hand hygiene is not limited to fixed areas, but occurs quite often at temporary sites, such as playgrounds, school yards, picnic areas, sports fields, and the like. Accordingly, there is a need in the art for a portable dispenser for such solutions, and one which is preferably disposable.

It will be appreciated that the concept of the invention herein, while typically described with relation to the dispensing of liquid or foamed soap, or other sanitizing solutions, is adaptable to the dispensing of a large variety of liquids. Particularly, condiments such as mustard and ketchup can be dispensed from the portable dispenser described herein, as can shampoos, hair conditioners, and the like.

SUMMARY OF THE INVENTION

In light of the foregoing, it is a first aspect of the invention to provide a portable liquid dispenser that eliminates the need for an outer housing or cover, but in which the container for the liquid itself comprises such cover.

Another aspect of the invention is the provision of a portable liquid dispenser that is cost effective, by being of a blow molded nature.

Yet another aspect of the invention is the provision of a portable liquid dispenser which is configured to be readily stacked within a box, accommodating efficiencies of shipment.

A further aspect of the invention is the provision of a portable liquid dispenser that employs a sealed pump and a vented container, substantially reducing the possibility of leakage during shipment and handling.

Another aspect of the invention is the provision of a portable liquid dispenser that includes a combination fill and relief valve at an uppermost portion thereof, to allow for the use of a sealed pump while accommodating ease of filling of the dispenser and the preclusion of collapsing during dispensing.

Still a further aspect of the invention is the provision of a portable liquid dispenser that includes the addition of a handle at the top of the bottle for ease of transport, the handle being hollow to provide for additional fill capacity.

A further aspect of the invention is the provision of a portable liquid dispenser that provides a low cost alternative to presently existing systems, such as "bag and box" and/or cartridge type systems.

Yet another aspect of the invention is the provision of a portable liquid dispenser that can be securedly engaged on a vertical wall, or maintained upon a horizontal surface.

Still a further aspect of the invention is the provision of a portable liquid dispenser which is economical and durable, reliable in use, and readily produced using state of the art technology.

The foregoing and other aspects of the invention which will become apparent as the detailed description proceeds are achieved by a liquid dispenser, comprising: a housing defining a hollow container; a handle on an upper portion of said housing; a walled aperture passing through said housing; and a dispensing pump received within said walled aperture and extending into said container.

Yet other aspects of the invention that will become apparent herein are attained by a liquid dispenser, comprising: a unitary housing defining a hollow interior; a walled aperture passing through said housing from a front wall to a back wall thereof; a pump received within said walled aperture and in communication with said hollow interior; and a valve at an upper portion of said housing, said valve accommodating filling of said hollow interior with liquid, exhausting of air during such filling, and replenishing of air within said hollow interior as liquid is dispensed therefrom by said pump.

DESCRIPTION OF DRAWINGS

For a complete understanding of the objects, techniques and structure of the invention, reference should be had to the following detailed description and accompanying drawings wherein.

BEST MODE FOR CARRYING OUT THE INVENTION

Figure 1:
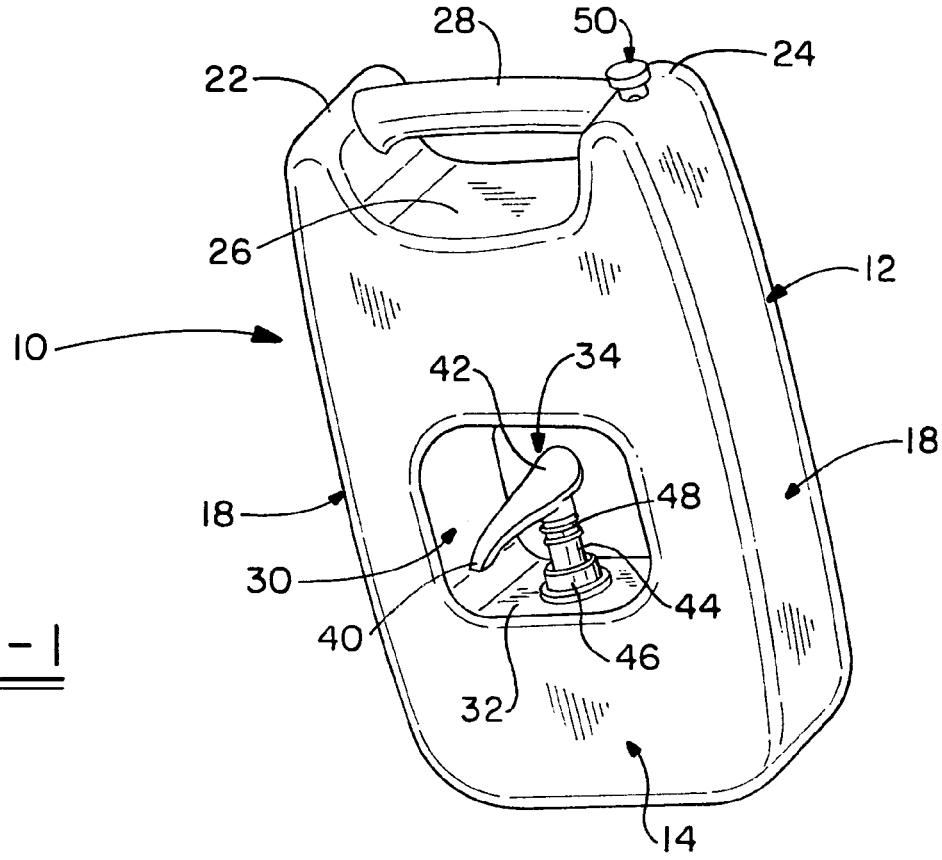
FIG. 1 is a front perspective view of the portable liquid dispenser of the invention, showing the pump thereof in the operative position.
Figure 2:
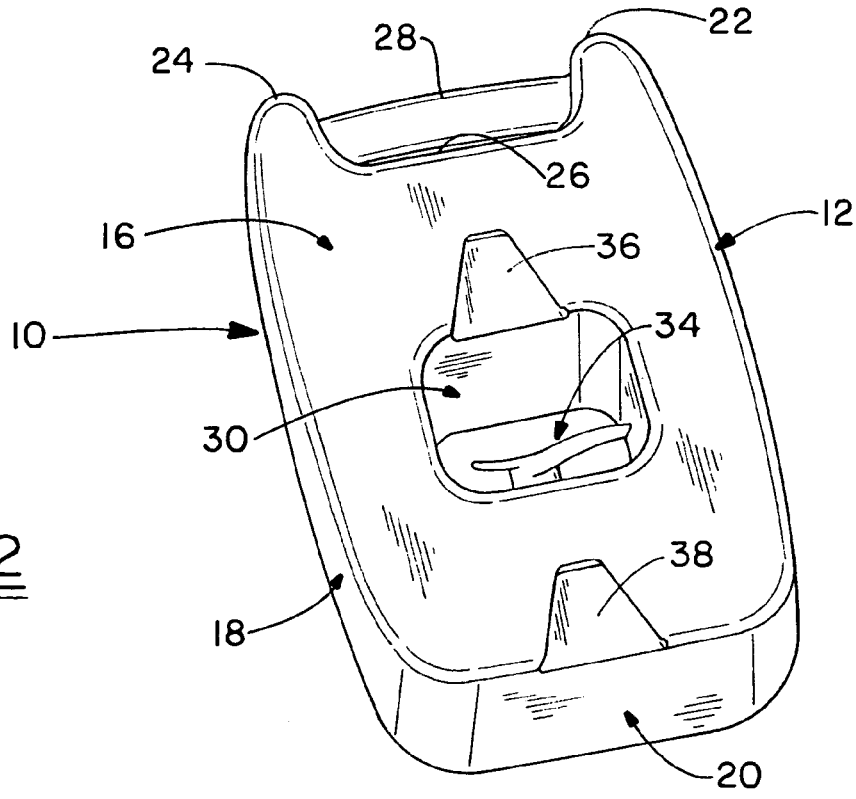
FIG. 2 is a rear perspective of the portable liquid dispenser of the invention, showing the pump in the closed and locked position.

Referring now to the drawings and more particularly FIGS. 1-4, it can be seen that a portable liquid dispenser made in accordance with the invention is designated generally by the numeral 10. The dispenser 10 comprises a housing or casing 12 which, in the preferred embodiment, comprises a unitary body, which is preferably blow molded of an appropriate plastic material. The dispenser 10 includes a front 14, a back 16, sides 18, and a bottom 20. At the top of the dispenser 10, a pair of ears 22, 24 extend above a trough 26, which is bridged by a handle 28. It will be appreciated that, in the context of the contemplated invention, the entirety of the housing 12, including the handle 28, is hollow, comprising a container region that can be filled with the liquid to be dispensed.

A walled aperture 30, typically rectangular in nature, passes between the front wall 14 and back wall 16, as shown. A bore 32 passes through a bottom wall of the walled aperture 30, and is configured to receive a pump 34 for pumping and dispensing the liquid to be contained within the portable liquid dispenser 10. The pump 34 may be any suitable pump, such as a liquid pump, foam pump, positive displacement pump, siphon pump, or the like. In accordance with the preferred embodiment of the invention, the pump 34 is sealed and non-vented, allowing the entirety of the hollow container defined by the housing 12 to be filled with liquid, without the pump leaking. In other words, the entirety of the hollow interior of the housing 12 will be filled with liquid, including the ears 22, 24 and the handle 28, which are positioned well above the pump.

On the back 16 of the dispenser 10, are a pair of undercut detents 36, 38 which are, in the disclosed embodiment, of a truncated triangular or trapezoidal nature. These undercut detents are provided for hanging of the portable liquid dispenser upon an appropriate receptacle, such as a nail, screw head, or the like. Accordingly, the dispenser 10 may be readily received upon a vertical flat surface, such as a wall. Similarly, the bottom 20 of the portable dispenser 10 is flat, capable of being received upon a flat horizontal surface, such as a table or bench top, or the like.

As presented above, the pump 30 may be of any of numerous configurations, while residing within the context of the invention. However, in the disclosed embodiment, the pump 34 includes a spout 40 from which the liquid is dispensed. A push or actuating surface 42 is provided for engagement by a user's hand or fingers, to depress the pump to achieve the desired dispensing action. In this regard, a stem 44 extends from the actuating surface 42 and through a collar 46 into the interior of the housing 12.

Figure 4:
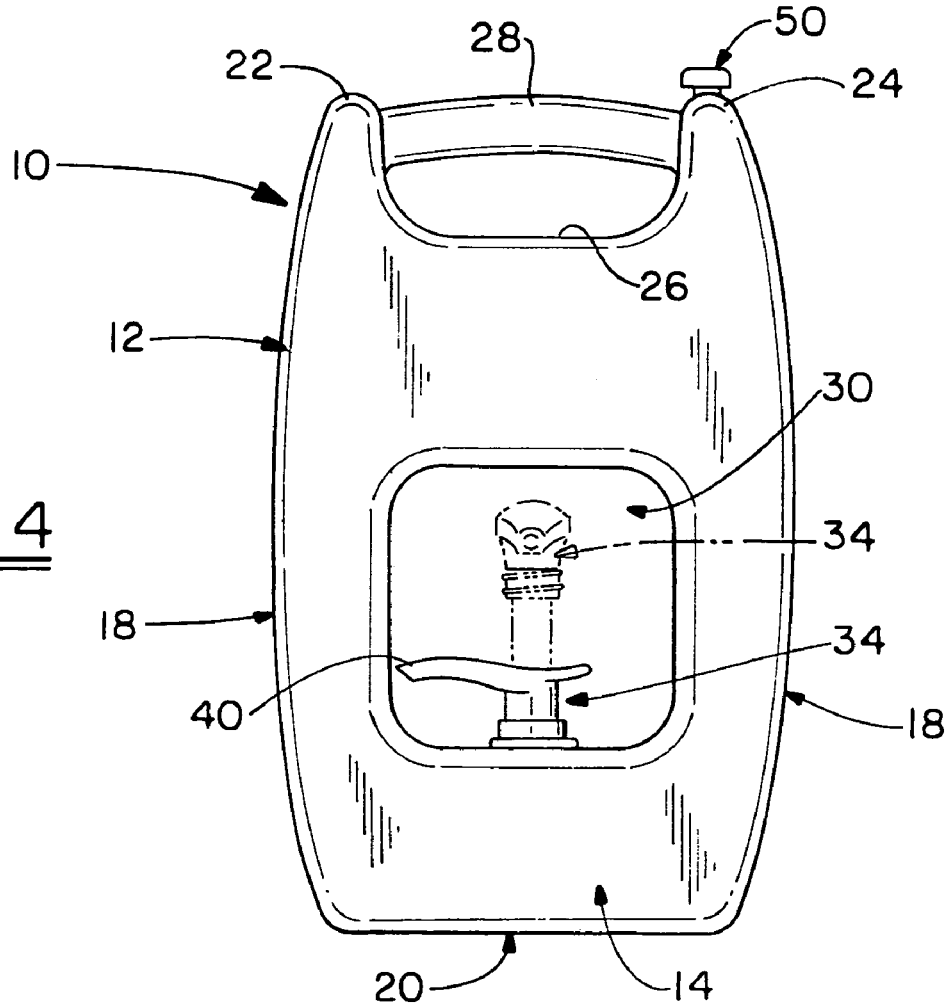
FIG. 4 is a front elevational view of the portable liquid dispenser of the invention, showing the pump in the alternative down and locked position for transport and the up and extended position (in phantom) for use.

In accordance with the preferred embodiment, the pump 34 is configured to be totally contained within the walled aperture 30 to accommodate stacking and packaging of the portable dispensers 10 for shipment and the like. Further, it is desired that the pump 34 be so fully contained to prevent inadvertent actuation of the pump, which might otherwise occur if it extended beyond the confines of the walled aperture 30 during periods of non-use or transport. Accordingly, the stem 44 is provided with locking threads 48, readily understood by those skilled in the art, to provide a means for lockingly retaining the stem 44 and push surface 42 during such periods of time. FIG. 4 shows, in sold lines, the pump 34 in its down and locked position, totally confined within the walled aperture 30. The phantom depiction in FIG. 4 of the pump 34 shows its extended unlocked and operative position.

Those skilled in the art will readily appreciate that this feature allows not only for safety during shipping, handling, carrying and the like, but also provides the dispenser 10 with a size and configuration that is fully retained within its footprint, and which is give to ease of packaging and shipping.

It will further be appreciated that the total mechanism of the invention, including the housing 12, pump assembly 32, and fill and relief valve 50, to be discussed below, are of a sufficiently inexpensive nature to render the portable dispenser 10 disposable.

Figure 3:
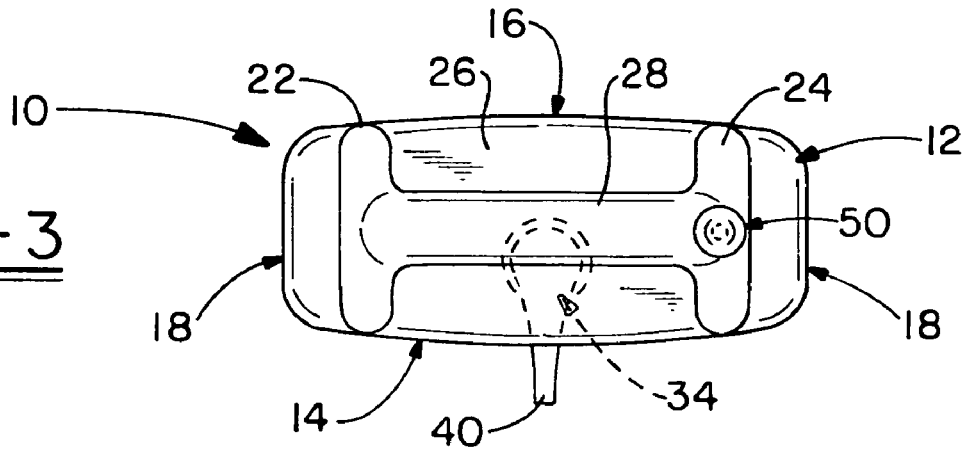
FIG. 3 is a top plan view of the portable liquid dispenser of the invention, showing the pump extended for operation.

As shown in FIGS. 1, 3 and 4, a fill and relief valve 50 is provided at the uppermost portion of the housing 12 and, in the preferred embodiment, at the top of one of the ears, 24, 26. The fill and relief valve 50 is provided to allow for the filling of the hollow interior of the housing 12 with liquid, while allowing for the venting of air from the container during such filling. Conversely, the fill and relief valve 50 accommodates the entry of air into the container during dispensing of liquid therefrom, to accommodate pressure equalization. Accordingly, with the implementation of the fill and relief valve 50, the pump 34 may be a non-vented pump, not susceptible to leakage or the like.

Figure 5:
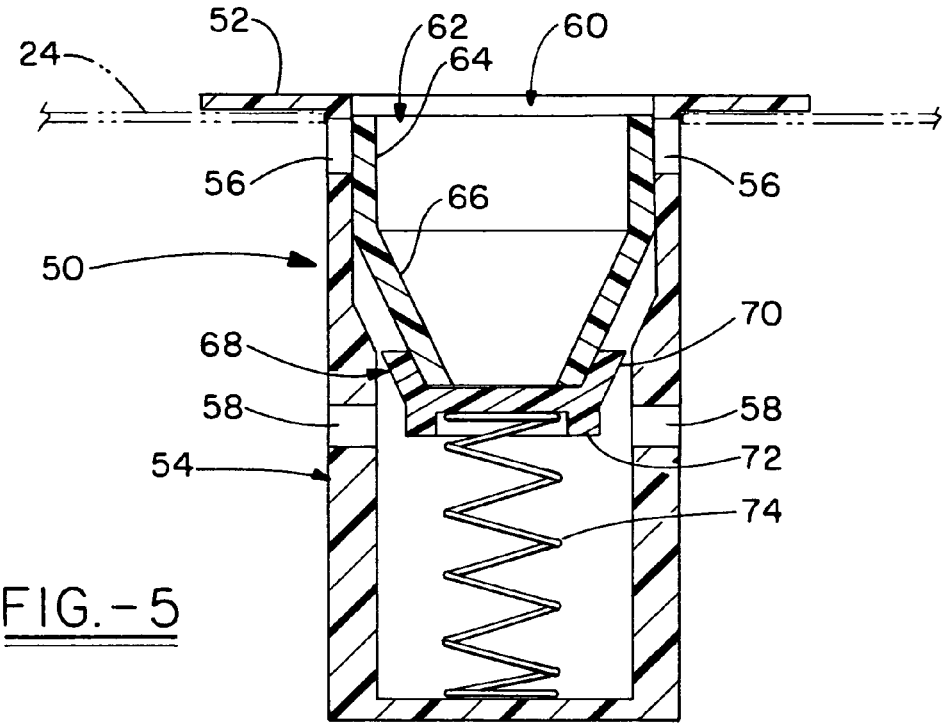
FIG. 5 is a cross sectional view of a fill and relief valve contemplated for employment with the portable liquid dispenser of the invention.
Figure 6:
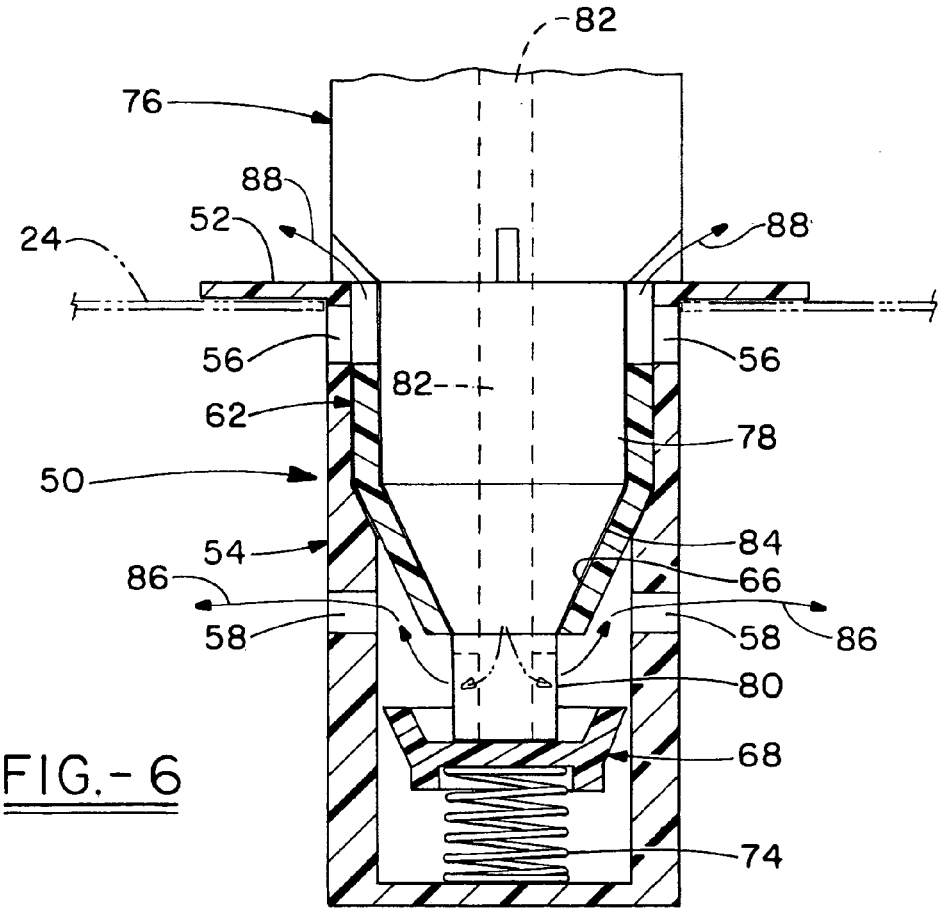
FIG. 6 is a cross sectional view of the fill and relief valve of FIG. 5, showing the same in the fill position.
Figure 7:
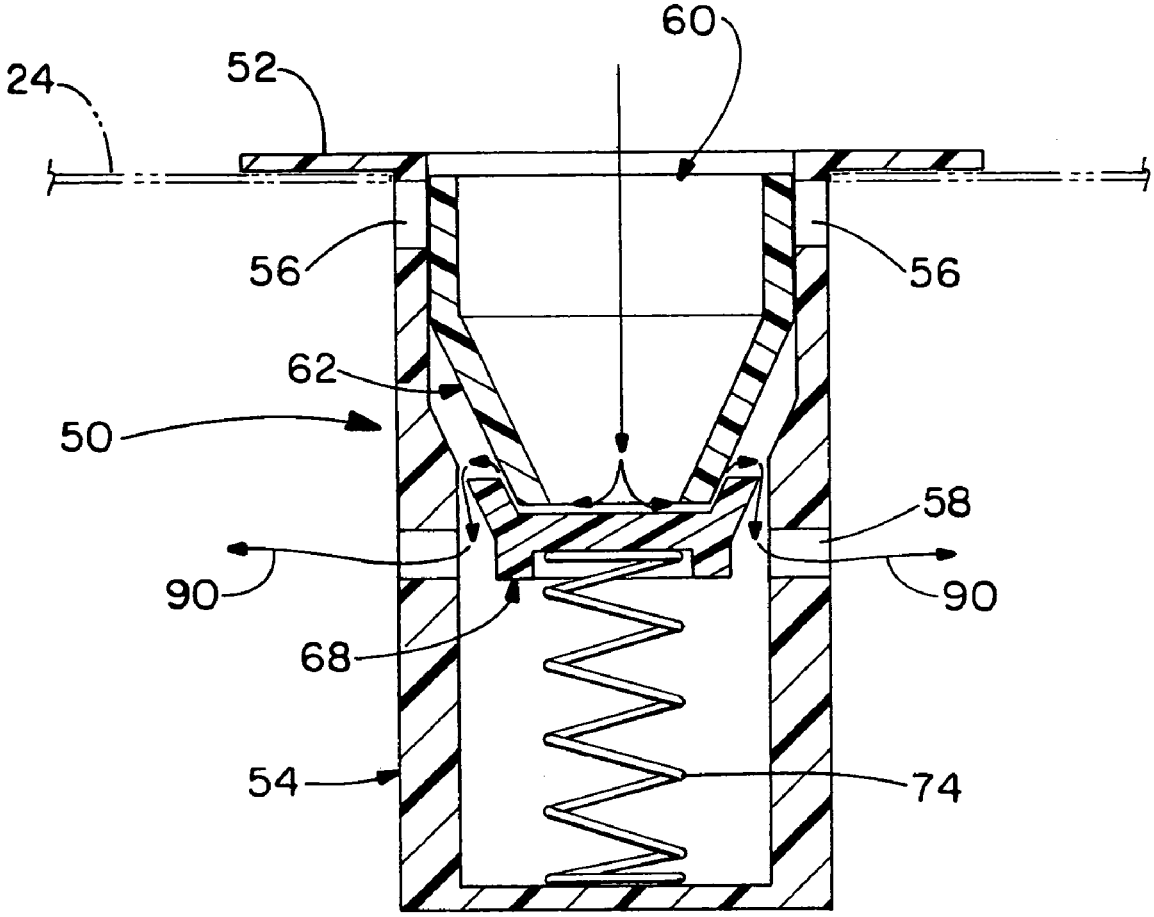
FIG. 7 is a cross sectional view of the fill and relief valve of FIGS. 5 and 6, showing the same in the operational position for dispensing of liquid.

With reference now to FIGS. 5-7, an appreciation can be obtained regarding the structure and operation of the fill and relief valve 50. As shown, the valve 50 includes a top collar 52, received about an aperture within an ear 24 of the housing 12. The valve 50 includes a cylindrical housing 54, with a plurality of upper apertures circumferentially spaced about a top portion thereof. The apertures 54 serve as outlet or exhaust apertures, allowing for the exhausting of air during the filling operation. Similarly, a plurality of lower apertures 58 are circumferentially spaced about a mid portion of the cylindrical housing 54, and serve the dual function of fill apertures for receipt of liquid having a fill operation and breather apertures for allowing the replenishment of air into the container during a dispensing operation.

The cylindrical housing 54 is open as at a top opening 60, and receives therein an upper valve member 62, which includes an upper cylindrical portion 64 extending to a truncated conical portion 66. A lower valve member 68 comprises an upper conical portion 70 connected to a lower cylindrical portion 72. As shown, the respective conical portions 66, 70 of the valve members 62, 68 nestingly and sealingly engage. A spring 74 interposed between the base of the cylindrical housing 54 and the cylindrical portion 72 of the valve member 68 urges the valve member 68 upwardly into closing and sealing engagement with the valve member 62.

With reference to FIG. 6, the operation of the fill and release valve 50 during a filling operation may be appreciated. As shown, a filler head 76 is provided in association with a reservoir of the liquid to be introduced into the interior cavity of the housing 12, and is provided with a body 78 having a cylindrical portion and a conical section to engage the upper seal member 62, as shown. Additionally, a cylindrical section 80 is provided on the filler head 76 to extend through the bottom opening of the conical portion 66 of the upper valve member 62, the cylindrical section 80 being configured to engage the lower valve member 68 and to separate it from the upper valve member 62, against the urging and biasing of the spring 74, as illustrated. A tubular fill member 82 is provided as a portion of the filler head assembly 76, 78 through which liquid may pass from a mass reservoir and into the cavity of the housing 12, as will be appreciated from reference to FIG. 6.

As shown, the conical portion 66 of the upper valve member 62 is configured to engage with a tapered shoulder 84 about the interior wall of the cylindrical housing 54. That engagement restricts downward movement of the upper valve member 62 against downward urging of the filler head assembly 76, 78. At this point, or even earlier, the lower valve member 68 separates from the upper valve member 62 against the urging of the spring 74, and breaks the seal between the upper and lower valve members 62, 68. At this point in time, as shown in FIG. 6, the apertures 56 are open from the interior of the container housing 12 to the top opening 60 of the cylindrical housing 54. The path allows for the exhausting of air during the filling operation. The upper valve member 62 is sealed against the shoulder 84 about the inner perimeter of the cylindrical housing 54. Similarly, the filler head assembly 76, 78 makes inner sealing engagement with the interior of the upper valve member 62.

With the lower sealing member 68 separated from the upper sealing member 62, a path is defined for transfer of liquid through the tubular member 82 from a mass reservoir to the interior of the container 12 through the circumferentially spaced apertures 58, in the direction of the arrows 86. The filling of the inner cavity of the housing 12 with liquid, forces the need for the escape of air therefrom through the circumferentially spaced upper apertures 56. This escape is along the path of the arrows 88.

As shown in FIG. 7, after the dispenser 10 has been filled and ready for use, the lower valve member 68 is in engagement with the upper valve member 62, with the upper valve member 62 sealingly engaging the upper apertures 56. When liquid is dispensed from the interior of the housing 12, there is a need for an ingress of air into the interior of the container to replace the liquid that was dispensed. Otherwise, the housing 12 would have a tendency to collapse or otherwise deform. To that end, the vacuum created in the interior of the housing 12 is sufficient to slightly draw the lower valve member 68 away from the upper valve member 62, to allow air from the ambient to enter through the opening 60 and between the valve member 62, 68, and thence into the interior of the housing 12 along the path of the arrows 90. Accordingly, the integrity of the housing 12 remains.

It will, of course, be appreciated that the fill and relief valve 50 might include a threaded top to receive a cap or the like, if desired. However, such sealing engagement is not necessary, since the spring biasing of the spring 74 keeps the aperture 56 in a normally sealed position, and keeps the upper and lower valve members 62, 68 in a normally sealed position, as well.

Thus it can be seen that the various aspects of the invention have been satisfied by the structure presented above. A disposable portable liquid dispenser, suitable for soaps, sanitizers, condiments, and various other liquids, has been presented. The entirety of the interior of the blow molded housing for the dispenser is adapted to receive and retain the desired liquid. The unvented pump allows for dispensing of the liquid, while locking of the pump during periods of transport and non-use, and positioning of the spout in an unobtrusive manner accommodates a maximization of space utility during packaging and shipping. The fill and relief valve accommodates rapid filling of the interior of the dispenser with the desired liquid in an automated process, while also accommodating breathing of the interior of the dispenser to replace dispensed fluid with air.

While in accordance with the patent statutes only the best mode and preferred embodiment of the invention has been presented and described in detail, the invention is not limited thereto or thereby. Accordingly, for an appreciation of the true scope and breadth of the invention, reference should be made to the following claims.

What is claimed is:

1. A liquid dispenser, comprising:

a housing defining a hollow container;

a handle on an upper portion of said housing;

a walled aperture passing through said housing; and a dispensing pump received within said walled aperture and extending into said container, said dispensing pump including a dispensing portion that is selectively positionable fully within said walled aperture and selectively positionable to place a portion thereof outside of said walled aperture.

2. The liquid dispenser according to claim 1, wherein said dispensing pump is unvented.

3. The liquid dispenser according to claim 1, wherein said walled aperture is substantially centrally positioned within said housing.

4. The liquid dispenser according to claim 1, wherein said housing and handle are formed as an integral hollow piece.

5. The liquid dispenser according to claim 4, wherein said housing has a flat bottom for receipt upon a horizontal surface, and receptacles for receipt upon a vertical surface.

6. The liquid dispenser according to claim 1, further comprising a vent at an upper portion of said housing.

7. The liquid dispenser according to claim 6, wherein said vent comprises a combination fill and relief valve accommodating filling of said hollow container with fluid and the exhausting of air therefrom.

8. A liquid dispenser comprising:

a housing defining a hollow container, said hollow container having an interior configured to receive a volume of fluid and a volume of air;

a handle on an upper portion of said housing;

a walled aperture passing through said housing;

a dispensing pump received within said walled aperture and extending into said container; and a combination fill and relief valve accommodating filling of said hollow container with said fluid and exhausting of said hollow container of said air, said fill and relief valve comprising:

a housing having first and second apertures therein in communication with said interior of said hollow container;

a first valve member received within said housing; and a second valve member received within said housing, said first and second valve members selectively accommodating entry of said liquid and said air into said interior of said hollow container and the exhausting of said air out of said interior of said hollow container.

9. The liquid dispenser according to claim 8, wherein said first valve member is selectively sealingly engaged with said second valve member.

10. The liquid dispenser according to claim 9, wherein said first valve member is biased to normally seal said first aperture and is movable to open said first aperture.

11. The liquid dispenser according to claim 10, wherein said first and second valve members are biased to sealed interengagement and separably moveable from said sealed interengagement to allow said liquid to pass therethrough and into said hollow container through said second aperture.

12. The liquid dispenser according to claim 11, wherein said air is drawn into said hollow container between an interface between said first and said second valve members and through said second aperture.

13. A liquid dispenser, comprising:

a unitary housing defining a hollow interior;

a walled aperture passing through said housing from a front wall to a back wall thereof;

a pump received within said walled aperture and in communication with said hollow interior, said pump including a dispensing portion that is selectively positionable fully within said walled aperture and selectively positionable to place a portion thereof outside of said walled aperture; and a valve at an upper portion of said housing, said valve accommodating a filling of said hollow interior with a volume of liquid, exhausting of a volume of air during said filling, and replenishing of a second volume of air within said hollow interior as said liquid is dispensed therefrom by said pump.

14. A liquid dispenser, comprising:

a unitary housing defining a hollow interior;

a walled aperture passing through said housing from a front wall to a back wall thereof;

a pump received within said walled aperture and in communication with said hollow interior, said pump including a dispensing portion that is selectively positionable fully within said walled aperture and selectively positionable to place a portion thereof outside of said walled aperture; and a valve at an upper portion of said housing, said valve accommodating a filling of said hollow interior with a volume of liquid, exhausting of a volume of air during said filling, and replenishing of a second volume of air within said hollow interior as said liquid is dispensed therefrom by said pump, wherein said valve comprises a valve body having a first aperture and a second apertures passing through said valve body and further wherein said first and second valve members are received by said valve body and in selective engagement with each other.

15. The liquid dispenser according to claim 14, wherein said first of said apertures comprises an air passage for an escape of air when said volume of liquid is introduced into said hollow interior through said second of said apertures.

16. The liquid dispenser according to claim 15, wherein said first and second valve members are separable to accommodate passage of air from outside of said hollow interior into said hollow interior through said second apertures as liquid is dispensed.

17. The liquid dispenser according to claim 14, wherein said unitary housing has a handle at a top portion thereof, and a fiat bottom for positioning the dispenser on a horizontal surface.

18. The liquid dispenser according to claim 17, wherein said unitary housing has a mounting receptacle on the back thereof for engagement with a support member for positioning the dispenser on a vertical surface.

* * * * *